United States Patent [19]

Wunsche

[11] 3,952,140

[45] *Apr. 20, 1976

[54] MODULAR DIVISIBLE BARREL-SHAPED SHELL FOR METALLURGICAL FURNACES

[75] Inventor: Edgar Wunsche, Oshawa, Canada

[73] Assignee: Engineered Metal Products Company, Inc., Birmingham, Ala.

[ * ] Notice: The portion of the term of this patent subsequent to Mar. 18, 1992, has been disclaimed.

[22] Filed: Oct. 30, 1974

[21] Appl. No.: 519,236

Related U.S. Application Data

[63] Continuation of Ser. No. 277,142, Aug. 2, 1972.

[52] U.S. Cl. ..... 13/35; 13/10

[51] Int. Cl.[2] ..... F27B 14/08

[58] Field of Search ..... 13/10, 35, 9

[56] References Cited

UNITED STATES PATENTS

| | | | |
|---|---|---|---|
| 1,297,149 | 3/1919 | Greene | 13/10 |
| 1,304,350 | 5/1919 | Moore | 13/10 X |
| 1,445,860 | 2/1923 | Turek | 13/35 X |
| 3,871,632 | 3/1975 | Wunsche | 13/10 X |

*Primary Examiner*—R. N. Envall, Jr.
*Attorney, Agent, or Firm*—Burmeister, York, Palamatier, Hamby & Jones

[57] ABSTRACT

The disclosed horizontally divisible furnace shell comprises a spherically shaped bottom section and truncated cone cover-like shaped middle and top wall sections stacked upon the bottom section, the form of the middle and top sections resulting in barrel-shaped shell walls. Each of the three modular sections has a metal casing with a refractory lining which may be made of firebrick or fireclay. Each wall section has an inwardly projecting ledge at its lower end for supporting the refractory lining. For interconnecting and aligning the sections, tapered locating pins and sockets are provided between all sections. Water-cooled flanges are preferably provided at the upper and lower ends of the top wall section. The joint between the middle and top wall sections is stepped upwardly adjacent the pouring spout so that such joint will be above the level of the molten metal, even when the furnace is tilted to pour out the metal. The middle wall section is provided with a molten metal discharge opening and a pouring spout extending outwardly beneath such opening. At least one slag discharge opening is formed in the middle and top wall sections. Modular removable water-cooled members are provided along the sides and the top of such slag discharge opening. A movable water-cooled heat resistant door is provided to close the slag discharge opening. Beneath the slag discharge opening, the middle wall section is provided with an apron which preferably has refractory material in the form of graphite blocks to prevent the slag from adhering to the apron. The bail for lifting and transporting the separate modular shell sections has a nonsymmetrical shape and adjustable links, such shape being adapted to accommodate the middle and top wall sections, which have different lifting point locations and different centers of gravity. Using the lifting bail, the entire middle or top wall section, complete with its refractory lining, may then be lifted from the furnace or into place on the furnace. Thus, the worn-out refractory lining may be removed from the shell section, and the new lining may be installed when the wall section is dismounted from the furnace. It is preferred to provide spare wall sections so that they can be fitted with new refractory linings while the furnace is operating. The replacement of the used wall section or sections having worn-out refractory linings with the spare wall section or sections having new refractory linings may be performed quickly, with only a short shutdown of the furnace.

5 Claims, 17 Drawing Figures

FIG. 4
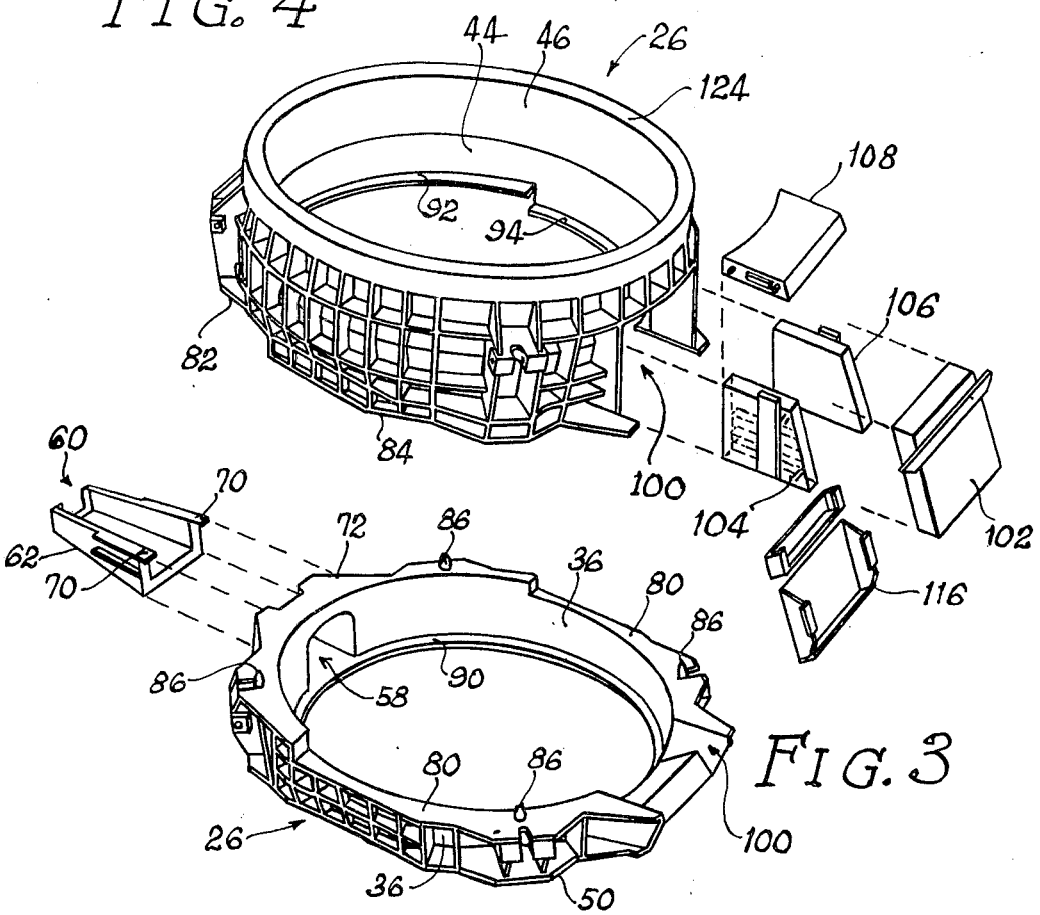
FIG. 3
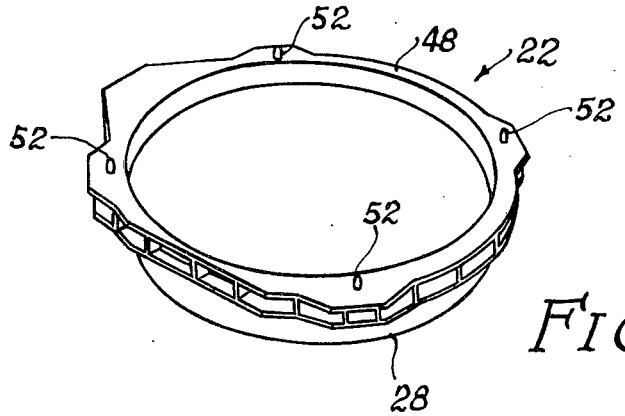
FIG. 2

TO BOSH TANK
MAIN INLET
INLET
OUTLET
DOOR SHAFT

MODULAR DIVISIBLE BARREL-SHAPED SHELL FOR METALLURGICAL FURNACES

This application is a continuation of my copending application, Ser. No. 277,142, filed Aug. 2, 1972.

This invention relates to a furnace shell for use with molten metal. For example, the furnace shell may be employed to melt steel scrap and for many other applications.

One object of the present invention is to provide an improved furnace shell which is modular in that it is made up of a plurality of sections or components which can readily be removed from the furnace for maintenance or replacement.

A further object is to provide such an improved furnace shell which requires only a very brief shutdown to repair or replace the refractory lining of the entire wall of the furnace.

Another object is to provide an improved furnace shell which is barrel shaped at the middle and top wall sections, and thus is bulged outwardly to a diameter greater than that of the bottom section, and also greater than the upper diameter of the top section where the roof ring rests on the shell. Besides poviding more charging volume capacity, the barrel shape of the middle and top wall sections provides longer refractory life, especially in so-called "hot spots", because of increased distance between the electric arcs and the wall refractory lining, and therefore more uniform and lower thermal stress per square unit of refractory area. The barrel-shaped middle and top wall sections have the further advantage of decreasing the mechanical stress on lower brick courses because a part of the gravitational load is borne by the upwardly flaring conical metal casing of the shell. An added advantage of the barrel-shaped middle and top wall sections resides in the fact that the patching material, which is thrown against the walls by hand or mechanically, stays much better in the desired place because of the outward conicity of the refractory lining in the most commonly patched or repaired area. Furthermore, the barrel-shaped middle and top sections result in more uniform thermal stress along the entire inside surface of the refractory lining, allowing usage of a thinner refractory lining at the upper part of the top wall section. As a further advantage, the barrel-shaped middle and top wall sections result in longer roof refractory life because of more uniform thermal stress caused by wide spreading of reflected heat radiation by the barrel-shaped walls over the entire inside surface of the roof.

In accordance with the present invention, the improved furnace shell is preferably modular in that it comprises two wall sections which can be separated when it is desired to do maintenance work on the sections. Preferably, the furance comprises three exchangeable sections including a bottom section, a middle wall section, and a top wall section. The bottom section is preferably spherically shaped, while the wall sections are generally truncated cone cover-like shaped. Each section preferably comprises a metal casing and a refractory lining mounted therein. The lining may be made of firebricks, fireclay or other refractory materials.

When it is necessary to replace the worn-out refractory lining of the furnace, either partially or entirely, the top wall section may be removed from the furnace. The middle wall section may also be removed as needed. It is preferred to provide spare sections which are fitted with refractory linings before the furance is taken out of service. To support the refractory linings, the wall sections are preferably provided with inwardly projecting ledges or flanges adjacent their lower ends.

After the old sections have been removed from the furnace, the space sections may be lifted, complete with their refractory linings, and may be mounted on the furnace. The horizontal joints between the new refractory linings of the three sections are then filled and sealed with refractory material such as fireclay. The prelined sections can be assembled on the furnace in much less time than would be required to replace the refractory lining of the furnace, without any provision for separating the furnace into sections.

An improved reversible bail is preferably provided for lifting and transporting the separate modular shell sections. The bail preferably has a non-symmetrical shape and adjustable links so that the bail is adapted to accommodate the middle and top wall sections, which have different lifting point locations and different centers of gravity.

The horizontal joint between the bottom section and the middle section is preferably below the normal slag line, while the joint between the middle and top wall sections is preferably above the slag line. It is preferred to construct the wall sections so that the joint between the wall sections has a rectangular step. The upper level of the step is adjacent the discharge opening through which the molten metal is poured out of the furnace, while the lower level of the step is positioned away from the discharge opening. In this way, the joint remains above the slag line when the furnace is tilted or rocked to pour out the molten metal.

Preferably, the top wall section has upper and lower border flanges which are hollow to provide passages through which cooling water or some other fluid coolant may be circulated. The top section is formed with an opening or openings through which excess slag may be poured out. Such opening may be lined with a plurality of removable members having passages therein through which cooling water or some other fluid coolant may be circulated. A movable door is preferably provided to close ths slag discharge opening. The door may also have passages therein for the circulation of a fluid coolant.

The middle wall section is preferably provided with a pouring spout projecting outwardly therefrom beneath the discharge opening for the molten metal. The spout preferably comprises a metal structure which is removably mounted on the middle wall section so that it can be replaced as needed. A refractory lining may be mounted in the metal structure of the pouring spout.

The middle wall section also preferably comprises an apron or sill which projects outwardly therefrom beneath the slag discharge opening. Such apron preferably comprises a removable metal shell which supports a refractory lining, preferably in the form of graphite blocks having high heat conductivity. This construction has the advantage that the slag and metal will not adhere to the graphite material.

Further objects, advantages and features of the present invention will appear from the following description, taken with the accompanying drawings, in which:

FIG. 2 is a perspective view showing the bottom section of the furnace shell.

FIG. 3 is a perspective view showing the middle or intermediate wall section with the pouring spout in a detached position.

FIG. 4 is a perspective view showing the top wall section of the furnace shell, with the door, the apron, and the components for lining the slag discharge opening in detached positions.

It will be understood that the drawings and the following description are merely illustrative in that they disclose a particularly meritorious embodiment of the present invention.

Figure 1:
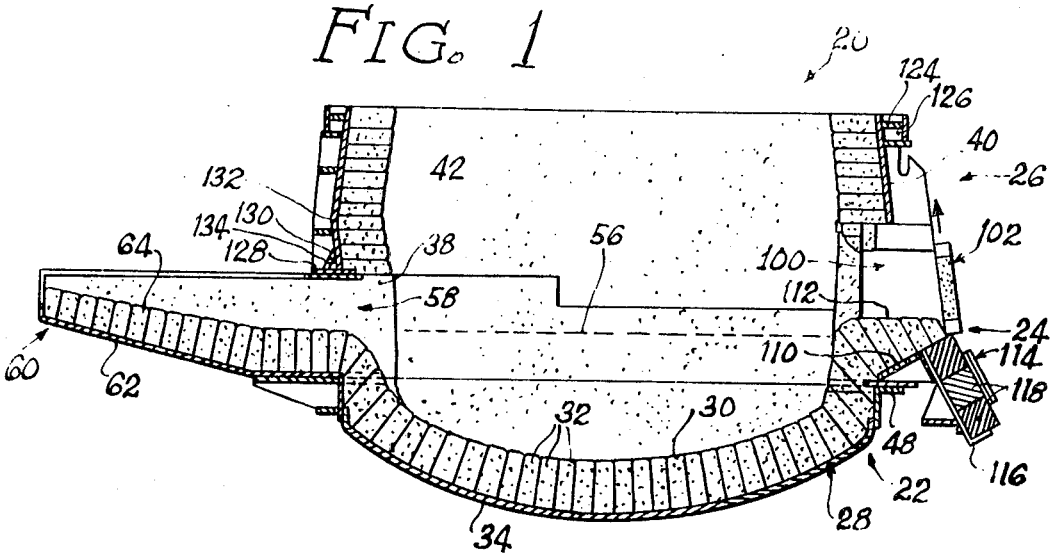
FIG. 1 is a central vertical section taken through a modular furnace shell to be described as an illustrative embodiment of the present invention.

As just indicated, FIG. 1 illustrates a furnace shell 20 for use with molten metal. For example, the furnace shell 20 may be employed to melt steel scrap or other metals. The furnace shell 20 is adaptable to many other uses.

As shown in FIG. 1, the furnace shell 20 has a bottom section 22 and middle and top wall sections 24 and 26 stacked upon the bottom section 22. Thus, the middle wall section 24 is mounted on top of the bottom section 22, while the top wall section 26 is mounted on top of the middle wall section 24. It will be understood that the top wall section 26 is adapted to support a cover or roof section, which may be of any known or suitable construction. The heat to melt the metal in the furnace may be supplied by electric arcs between electric arc electrodes, projecting downwardly into the furnace through openings in the roof section in a manner which will be familiar to those skilled in the art.

It will be seen from FIG. 1 that the bottom section 22 is generally spherically shaped and is formed with a metal casing or shell 28 having a refractory lining 30. Any known or suitable material may be employed in the refractory lining, such as the illustrated firebricks 32. Fireclay or some other heat-resistant material may be employed to complete the refractory lining 30.

The bottom section 22 of the furnace shell 20 is supported in any known or suitable manner so that the furnace shell may be tipped or rocked to pour out the molten metal. The illustrated metal shell 28 has a smoothly rounded bottom portion 34 to provide for the rocking or tilting of the furnace shell.

The middle wall section 24 of the furnace shell 20 is generally ring-shaped and is also provided with a metal casing or shell 36 (FIGS. 5–7) having a refractory lining 38, which may be made of firebricks and fireclay, or any other known or suitable refractory material.

The top wall section 26 is also ring-shaped. It comprises a metal casing or shell 40 having a refractory lining 42 which may be made of firebricks and fireclay or any other suitable refractory materials.

Figure 5:
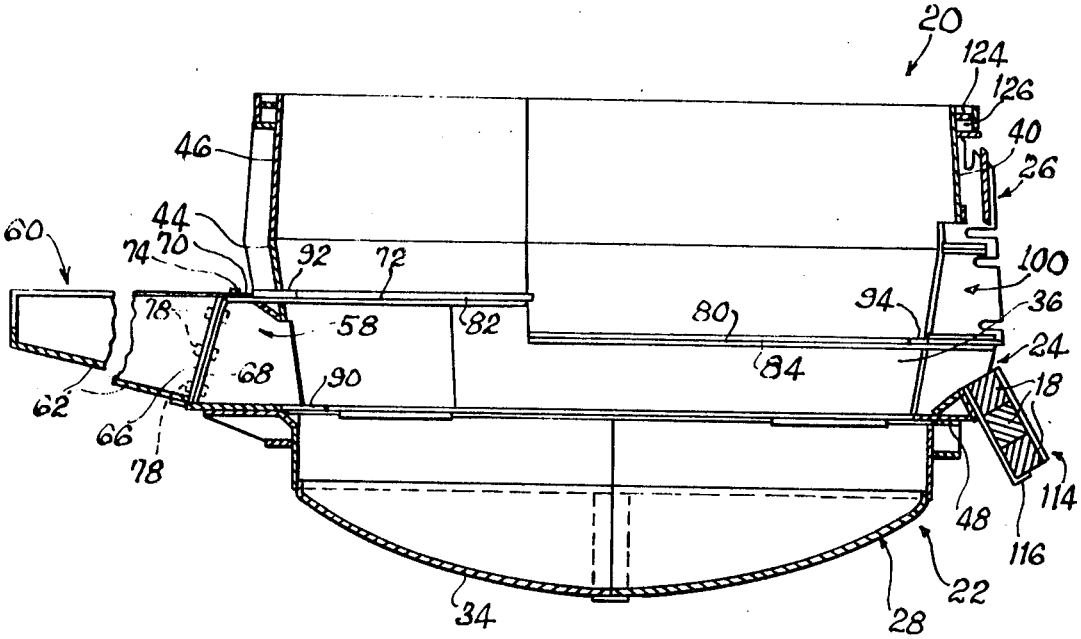
FIG. 5 is a central vertical section, similar to FIG. 1 but with the refractory lining removed from the furnace shell.
Figure 6:
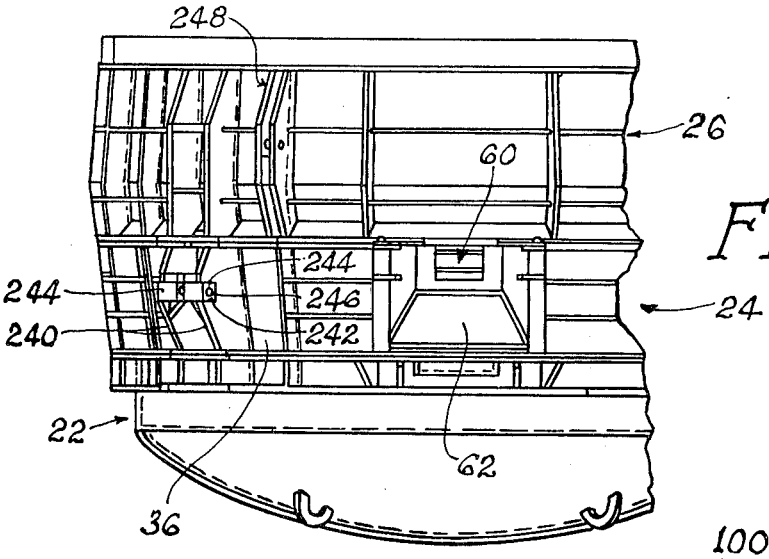
FIG. 6 is a fragmentary side elevation of the furnace shell looking toward the pouring spout for the molten metal.

It will be seen from FIGS. 1 and 5 that the wall sections 24 and 26 are barrel-shaped in that they bulge outwardly to a diameter greater than that of the bottom section 22, and also greater than the upper diameter of the top section 26. Thus, the middle or intermediate wall section 24 is generally frusto-conical in shape and flares outwardly in diameter between its lower and upper ends. The top wall section 26 flares outwardly and then tapers inwardly between its lower and upper ends. Thus, the metal casing 40 of the top section 26 has a generally frusto-conical lower portion 44 which tapers downwardly and a generally frusto-conical upper portion 46 which tapers upwardly. As previously mentioned, it is advantageous to make the wall sections 24 and 26 barrel-shaped because the capacity of the furnace shell and its ability to withstand heat are thereby increased. The barrel shape of the wall sections provides more room for refractory material and a greater volume in the upper portion of the furnace shell where it is subjected to the intense heat of the electric arcs.

It will be evident from FIGS. 1 and 2 that the metal shell 28 of the bottom section 22 is formed at its upper end with a substantially horizontal outwardly projecting flange 48 adapted to be engaged by a similar outwardly projecting substantially horizontal flange 50 on the lower end of the metal shell 36 of the first or middle wall section 24. Locating elements are preferably provided on the bottom section 22 and the middle wall section 24 to align the middle wall section with the bottom section and to prevent any change in such alignment when the furnace shell is tipped to pour the molten metal therefrom.

Figures 9, 10, 11:
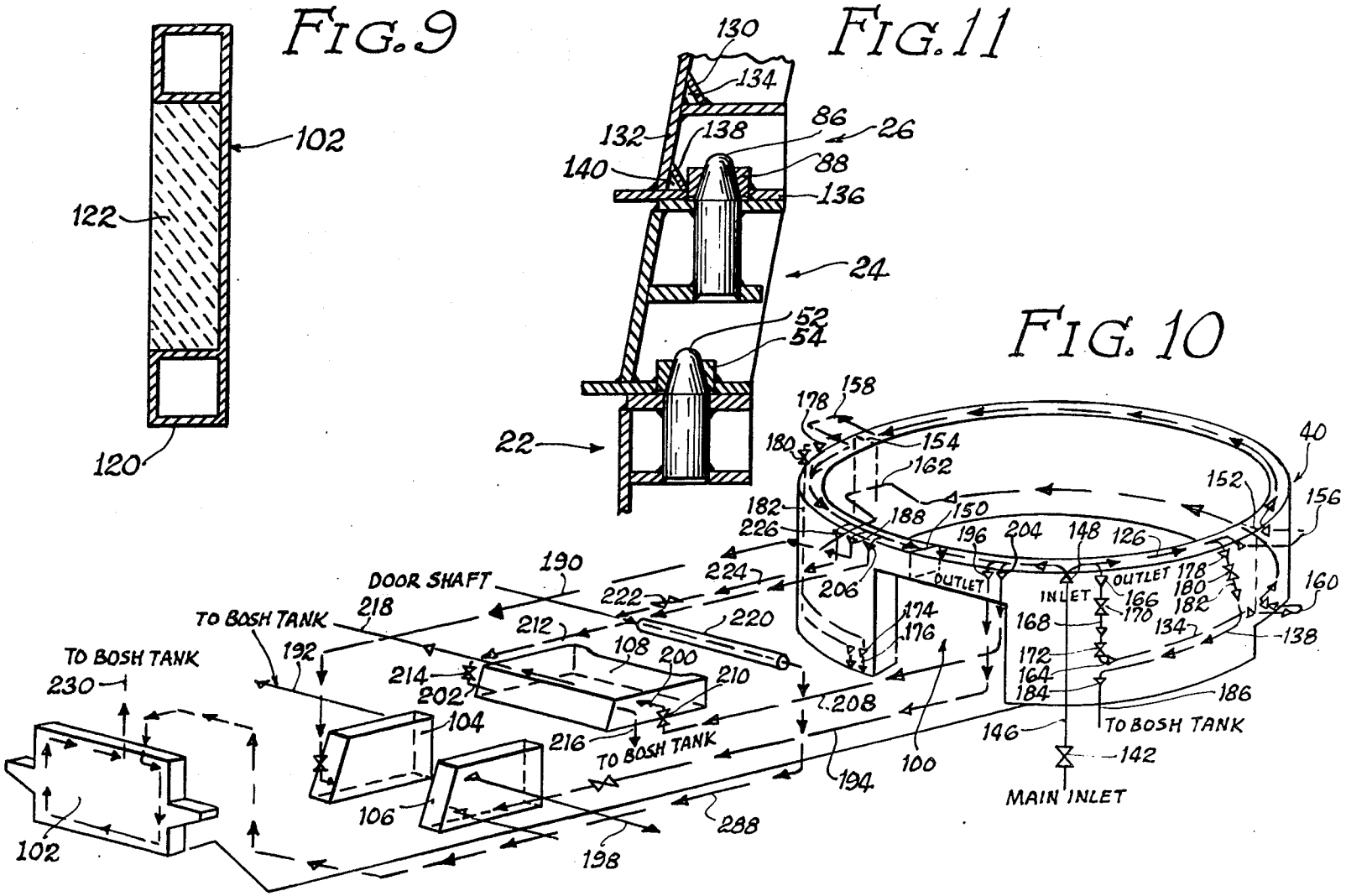
FIG. 9 is an enlarged vertical section taken through the door for the slag discharge opening.
FIG. 10 is a diagrammatic, exploded perspective view showing the system for circulating the cooling water through the various components of the furnace shell.
FIG. 11 is a fragmentary vertical section taken through the wall of the furnace shell, generally along the line 11—11 in FIG. 8, and showing the locating pins for maintaining alignment between the three sections of the furnace shell.

As shown in FIG. 2, such locating elements may take the form of pins 52 projecting upwardly from the horizontal flange 48 on the bottom section 22. The illustrated pins 52 are conically tapered. The pins 52 interlock with mating elements on the middle wall section 24. As shown in FIG. 11, such mating elements may take the form of tapered socket member 54 secured in suitable openings formed in the flange 50 on the middle wall section 24.

When the furnace shell 20 is in use, a pool of molten metal is contained within the bottom section 22 and the lower portion of the middle wall section 24 of the furnace shell 20. In most cases, a thin layer of slag will float on the surface of the molten metal. A typical level for the slag is indicated by a slag line 56 in FIG. 1. It will be noted that the slag line 56 is above the joint between the bottom section 22 and the middle wall section 24. It will be understood that the joint between the sections 22 and 24 is sealed by fireclay or some other suitable refractory material applied between the refractory lining 30 of the bottom section 22 and the refractory lining 38 of the middle wall section 24.

It will be evident from FIGS. 1 and 2 that a discharge opening 58 for the molten metal is formed through one side potion of the middle wall section 24. The refractory lining 38 of the wall section 24 extends into the discharge opening 58 so that it is completely lined by refractory material.

A pouring spout 60 is preferably provided on the middle wall section 24 to receive the molten metal from the discharge opening 58. The illustrated pouring spout 60 comprises a tapered generally trough-shaped metal structure or shell 62 which is provided with a refractory lining 64 made of firebricks and fireclay or other suitable refractory materials.

Preferably, the metal structure 62 of the pouring spout 60 is removably mounted on the metal casing 28 of the bottom section 22 so that the structure 62 of the spout 60 can readily be removed and replaced. As shown in FIG. 5, the metal structure 62 of the spout 60 is formed with inclined flanges 66 adapted to engage mating flanges 68 on the metal casing 36 of the middle wall section 24.

Horizontal flange elements or tabs 70 are also preferably provided on the metal structure 62 of the pouring spout 60 and are adapted to engage a horizontal flange 72 on the upper end of the middle wall section 24. Locating elements are preferably arranged to extend between the flange elements 70 and the flange 72.

Figure 12:
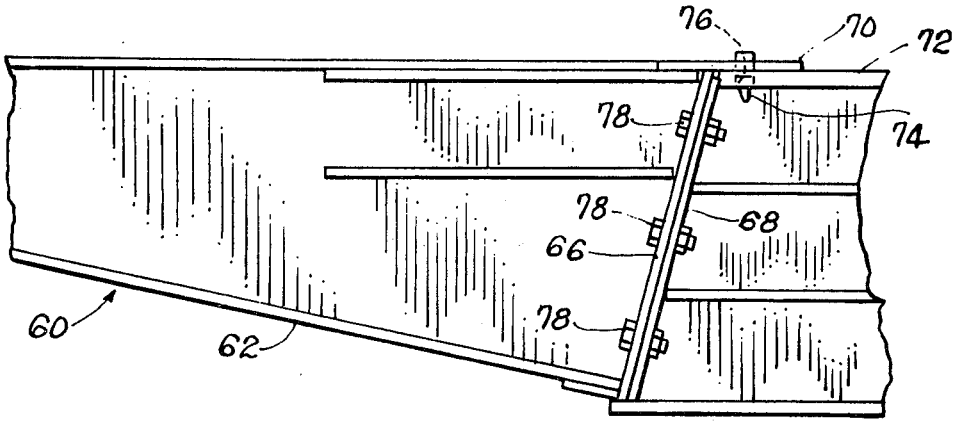
FIG. 12 is a fragmentary enlarged elevation showing the metal structure of the pouring spout.
Figure 14:
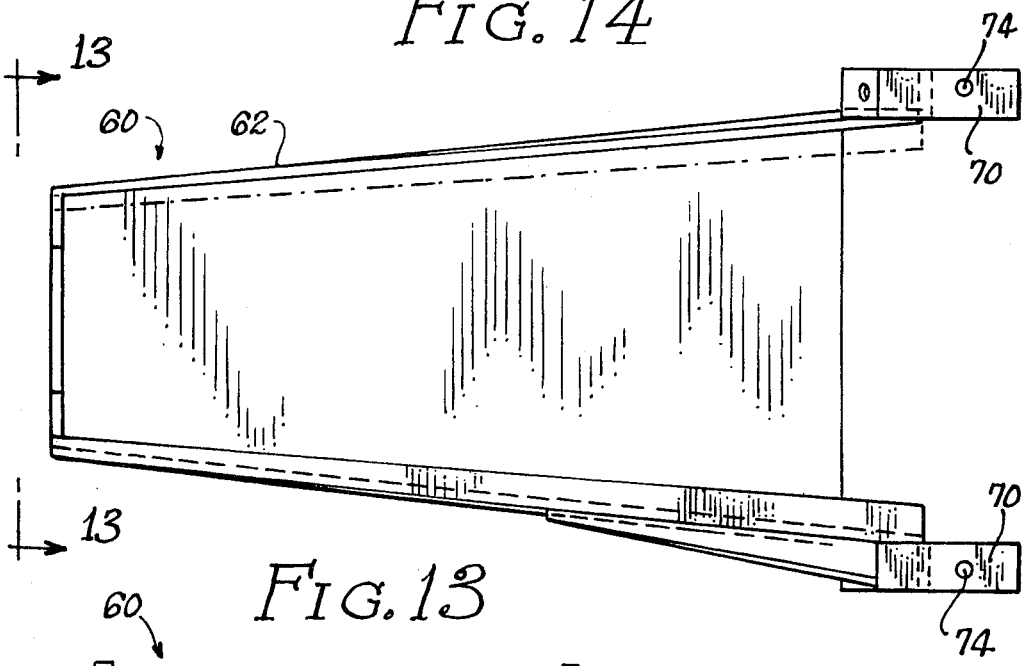
FIG. 14 is a plan view of the metal structure for the pouring spout.
Figure 13:
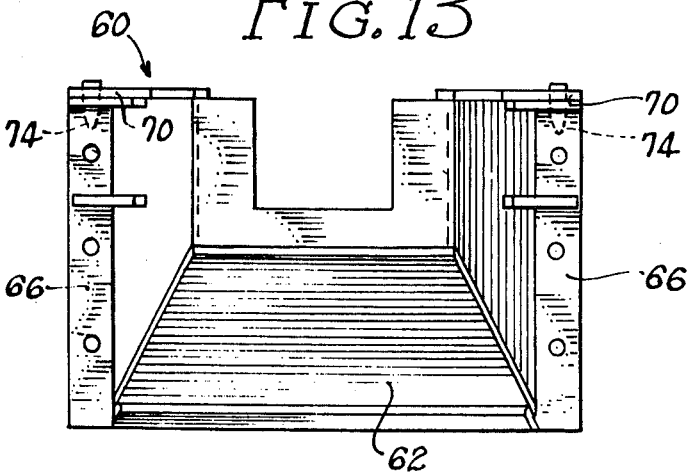
FIG. 13 is a side view showing the metal structure of the pouring spout, detached from the furnace shell, the view being taken generally as indicated by the line 13—13 in FIG. 12.

As shown to best advantage in FIGS. 12 and 13, such locating elements preferably include tapered pins 74 projecting downwardly from the flange element 70. Openings 76 are preferably formed in the flange 72 on the wall section 24 to receive the pins 74. It will be evident that the metal structure 62 of the spout 60 may be mounted on the middle wall section 24 by lowering the structure 62 into place so that the pins 74 are inserted through the openings 76. Bolts or other fasteners 78 may then be employed to secure the flanges 66 and 68 together. If the pouring spout 60 is damaged by heat or otherwise, it can be replaced quickly and readily.

It is preferred to form the middle wall section 24 with a stepped upper end portion. As will be evident from FIG. 3, the horizontal flange 72, previously mentioned in connection with FIG. 5, is stepped above a pair of horizontal flange elements 80 mounted on the upper end of the middle wall section 24. The flange 72, constituting the upper step, is adjacent the discharge opening 58, while the flange elements 80, constituting the lower step, are more remote therefrom.

This stepped construction has the important advantage that the joint between the middle and upper wall sections 24 and 26 is always above the slag line 56, even when the furnace shell 20 is tilted to pour out the molten metal through the discharge opening 58. The stepped construction makes it easy to fit firebricks into the wall sections 24 and 26 when the refractory linings 38 and 42 are being installed.

As will be evident from FIG. 4, the lower end of the top wall section 26 is similarly stepped to mate with the stepped upper end of the middle wall section 24. As shown, the lower end of the top wall section 26 is provided with an upwardly stepped flange 82 to mate with the flange 72 and downwardly stepped flange elements 84 to mate with the flange elements 80.

Locating elements are preferably provided between the middle and top wall sections 24 and 26 to maintain alignment between the sections. As before, such locating elements preferably take the form of tapered pins 86 projecting upwardly from the middle wall section 24. Tapered socket members 88 are preferably provided on the top wall section 26 to receive the pins 86, as shown in FIG. 11.

The refractory lining of the furnace shell 20 has only a limited life so that it is necessary to replace the refractory lining after the furnace has been in operation for a period of time. The furnace shell 20 must be taken out of service and shutdown in order to replace the refractory lining. To minimize the shutdown time, it is preferred to provide spares for the middle and top wall sections 24 and 26 of the furnace shell. While the furnace shell is in operation, using the original wall sections 24 and 26, the spares are provided with their refractory linings 38 and 42.

When it is necessary to shut down the furnace, the original wall sections 24 and 26 are removed from the furnace shell and the spares are hoisted into place complete with their refractory linings 38 and 42. Generally, the refractory lining 30 of the bottom section 22 will outlast several refractory linings for the wall sections 24 and 26, which are subjected to more intense heat and greater thermal shock. Thus, during the usual shutdown, it is not necessary to replace the refractory lining 30 of the bottom section 22. It is simply necessary to hoist the spare wall sections 24 and 26 into place complete with their refractory linings 38 and 42. Fireclay or other refractory material is then employed to seal the joints between the refractory linings 30, 38 and 42.

In order that the shutdown time of the furnace shell 20 may be minimized in this advantageous manner, the wall sections 24 and 26 are provided with means for supporting the refractory linings 38 and 42, even when the wall sections are dismounted from the furnace so that the refractory linings can be installed when the wall sections 24 and 26 are dismounted. As shown in FIGS. 3–5, such means may take the form of ledges 90, 92 and 94 projecting inwardly from the lower ends of the wall sections 24 and 26. The ledge 90 is on the lower end of the middle wall section 24, while the ledges 92 and 94 are on the upwardly and downwardly stepped portions at the lower end of the top wall section 26.

When the refractory linings 38 and 42 are installed, the firebricks are laid upon the ledges 90, 92 and 94. Thus, the refractory linings 38 and 42 are securely supported within the wall sections 24 abd 26 so that they can be hoisted into place on the furnace without damaging the refractory linings. The joints between the three sections 22, 24 and 26 are sealed by employing fireclay or some other refractory material to fill the spaces between the refractory linings 30, 38 and 42 of the three sections.

It will be seen from FIG. 1 that the illustrated furnace shell 20 is provided with a slag discharge opening 100, which, in this case, is formed primarily in the top wall section 26, but also is formed to some extent in the extreme upper portion of the middle wall section 24 diametrically opposite from the discharge opening 58 for the molten metal. A movable door 102 is preferably provided to close ths slag discharge opening 100. In this case, the door 102 is positioned at a small angle to the vertical and is slidable upwardly to open the opening 100.

In the illustrated construction as shown to best advantage in FIG. 4, the slag discharge opening 100 is lined by side members 104 and 106 and a top member 108, all of which are removable from the top wall section 26 so that the members 104, 106 and 108 can be removed and replaced as needed. The members 104, 106 and 108 are preferably made of metal and are hollow to provide passages therein for the circulation of water or some other fluid coolant.

The lower side of the slag discharge opening 100 is formed by a sill 110 on the metal shell 28 of the bottom section 22. The sill 110 may be lined with a suitable refractory material 112 such as firebricks, fireclay or the like.

A refractory or heat-resistant apron 114 is preferably provided on the outside of the furnace shell 20 beneath the slag discharge opening 110, the apron 114 being positioned so that the molten slag will flow over the apron 114 when the slag is discharged out of the furnace shell 20 through the opening 100. When the slag is to be discharged, the door 102 is opened. The furnace shell 20 may then be tilted slightly to cause the slag to pour out of the furnace shell through the opening 100. The furnace shell is not tilted sufficiently to allow any of the molten metal to escape.

In this case, the apron 114 comprises a metal supporting structure or shell 116 with a refractory lining 118, which may be made of various materials but is preferably made of graphite. The use of graphite has the advantage that the slag will not stick to the graphite material. As shown, the graphite refractory lining 118 is in the form of graphite blocks supported by the metal structure 116. Preferably, the metal structure 116 is readily removable from the wall section 24 so that it can be replaced as needed.

The door 102 is also of a heat-resistant construction. As shown in FIG. 9, the door 102 preferably comprises a metal frame 120 having a refractory lining 122, which may be made of firebricks, fireclay or the like. The illustrated metal frame 120 is hollow to provide passages for the circulation of cooling water or some other fluid coolant.

Fluid coolant passages may also be provided in the metal casing of the furnace shell 20, particularly in the metal casing 40 of the top wall section 26. As shown in FIG. 1, the metal casing 40 of the top wall section 26 has a border flange 124 which extends around the outside of the metal casing 40 at its upper end. The flange 124 is hollow to provide a circumferential passage 126 for cooling water or some other fluid coolant.

As shown in FIG. 1, the metal casing 40 of the upper wall section 26 also has an outwardly projecting border flange 128 which extends around the lower portion of the metal casing 40 at the level of the upper step 82. As shown, the flange 128 is provided with inclined reinforcing plates 130 which extend between the flange 128 and the circumferential wall 132 of the metal casing 40 to form a circumferential passage 134 for the circulation of cooling water or some other fluid coolant.

Additional cooling means may be provided on the metal casing 40 of the top wall section 26 at the level of the lower step 84. As shown in FIGS. 4 and 11, additional outwardly projecting border flanges 136 are provided on the metal casing 40 at the level of the lower step 84. There are two of the flanges 136 on opposite sides of the slag discharge opening 100. Reinforcing plates 138 are welded or otherwise secured between the flanges 136 and the circumferential wall 132 to form passages 140 for cooling water or some other fluid coolant.

As shown in FIG. 10, a system is provided for circulating cooling water or some other fluid coolant through all of the coolant passages in the furnace shell 20. The main supply of the cooling water is connected to the circumferential passage 126 at the upper end of the upper wall section 26, through a valve 142 and a main inlet pipe 146 connected to an inlet fitting 148. In addition to cooling the flange 124, the circumferential passage 126 serves as a supply header from which various branch cooling pipes and hoses receive their cooling water.

The passage 126 extends entirely around the upper end of the top wall section 26, except for a bulkhead 150 and walls 152 and 154 where the metal casing 40 is split initially for ease in shipment. When the furnace shell is assembled, the split portions of the metal casing 40 are welded or otherwise secured together at the walls 152 and 154. External bypass conduits 156 and 158 are provided to carry the cooling water around the walls 152 and 154.

The circumferential cooling passage 134 is also interrupted by the vertical walls 152 and 154 where the metal casing 40 is initially split for shipment. External bypass conduits 160 and 162 are provided to carry the cooling water around the walls 152. The passage 134 has an inlet 164 which is supplied with cooling water from an outlet 166 connected to the passage 126. A conduit 168 and valves 170 and 172 may be connected between the outlet 166 and the inlet 164. The water travels through the circumferential passage 134, including the bypass conduits 160 and 162, and is discharged from an outlet 174 into an outlet pipe 176 which may be connected to a collector or bosh tank from which the water is recycled or drained away.

Another outlet 178 is provided from the circumferential passage 126 to supply the cooling water to each of the passages 138. A valve 180 and a conduit 182 are connected between the outlet 178 and the passage 138. The other end of each passage 138 leads to an outlet 184 connected to another outlet pipe 186 which may lead to the collector tank.

The side member 104 is supplied with water from an outlet 188 connected to the circumferential passage 126. A conduit 190 leads from the outlet 188 to the side member 104. After passing through the member 104, the water is discharged to an outlet pipe 192 which may be connected to the collector tank.

Similarly, the other side member 106 is supplied with water by a conduit 194 connected to an outlet 196 from the passage 126. The water from the side member 106 is discharged to an outlet pipe 198.

As illustrated in FIG. 10, the top member 108, positioned in the slag discharge opening 100, is provided with two inlets 200 and 202 which are connected to outlets 204 and 206, leading from the circumferential passage 126. A conduit 208 and a valve 210 are connected between the outlet 204 and the inlet 200. Similarly, a conduit 212 and a valve 214 are connected between the outlet 206 and the inlet 202. After passing through the top member 108, the water is discharged to outlet pipes 216 and 218.

The door 102 is preferably provided with a hollow shaft 220 which is supplied with cooling water by a valve 222 and a conduit 224 connected to an outlet 226 from the passage 126. The water passes from the hollow shaft 220 to the door 102 through a hose or flexible conduit 228. After passing through the coolant passages in the door 102, the water is discharged to outlet hose or conduit 230.

Figure 7:
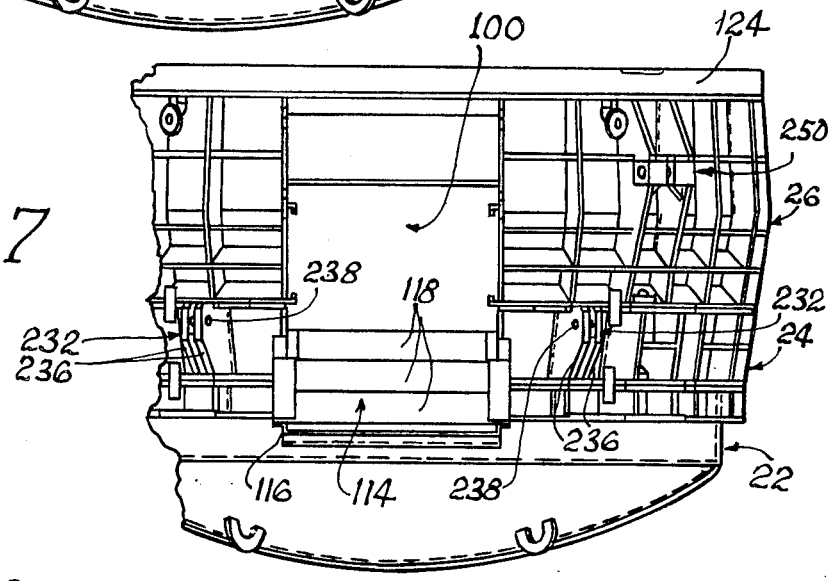
FIG. 7 is a fragmentary view of the opposite side, looking toward the slag discharge opening.
Figure 8:
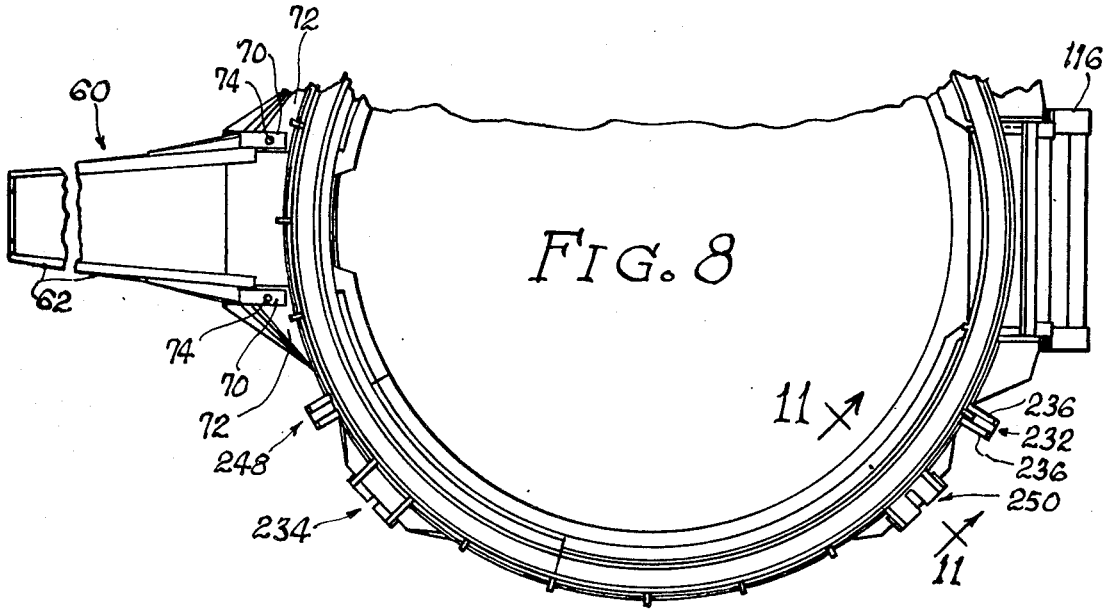
FIG. 8 is a fragmentary plan view of the furnace shell.

Elements are preferably provided on the wall sections 24 and 26 for the attachment of a lifting bail or some other lifting device. As shown in FIGS. 7 and 8, the middle wall section 24 may be provided with two pairs of lifting elements 232 and 234. Each of the illustrated lifting elements 232 comprises a pair of lugs or ribs 236 which are formed with openings 238 adapted to receive pins or the like whereby lifting links or other elements may be connected to the rubs 236. Similarly, each of the lifting elements 234 comprises a pair of ribs or lugs 240 having notches or openings 242 therein to receive blocks 244, which may be welded to the ribs 240. Openings 246 are formed in the blocks 244 to receive a pin or the like whereby a link or other lifting device may be connected to the lifting element 234.

Similarly, the illustrated top wall section 26 is formed with two pairs of lifting elements 248 and 250 which are similar to the lifting elements 232 and 234, respectively. The lifting elements on the middle and top wall sections 24 and 26 are positioned so that each wall section will be properly balanced when it is being hoisted. In this way, each wall section will hang level from the bail or other hoisting device.

Figure 15:
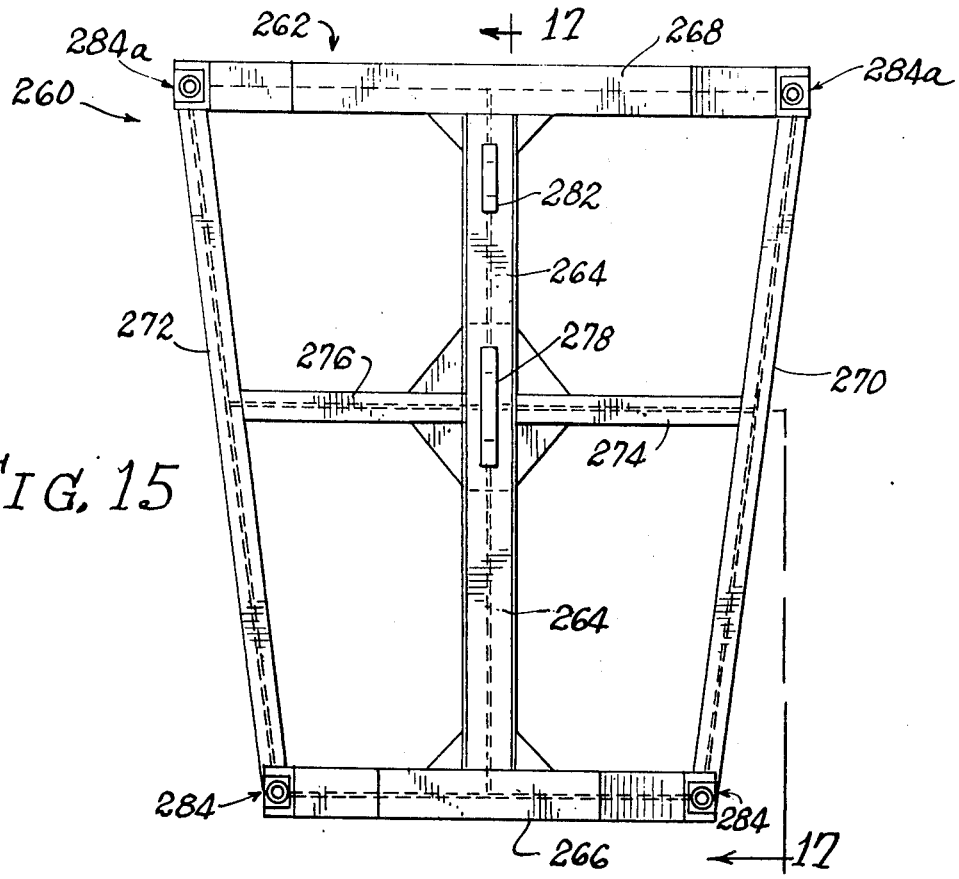
FIG. 15 is a plan view of an improved bail which may be employed for lifting the middle and top wall sections of the furnace shell.
Figure 16:
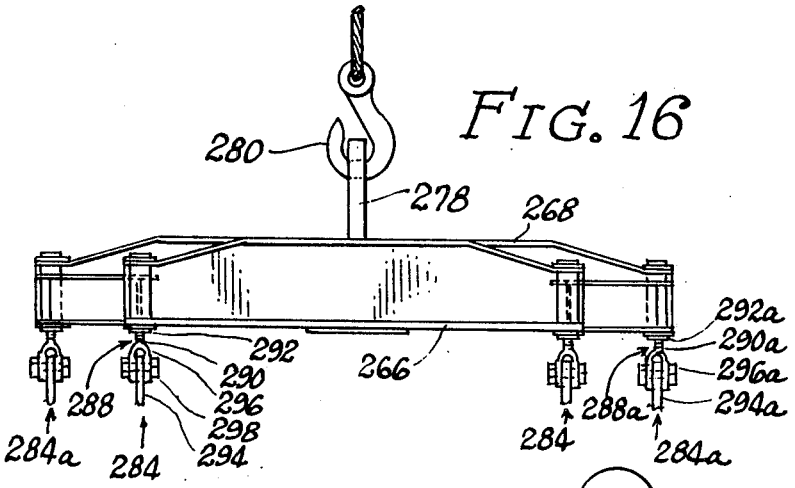
FIGS. 16 and 17 are front and side elevations of the bail of FIG. 15.
Figure 17:
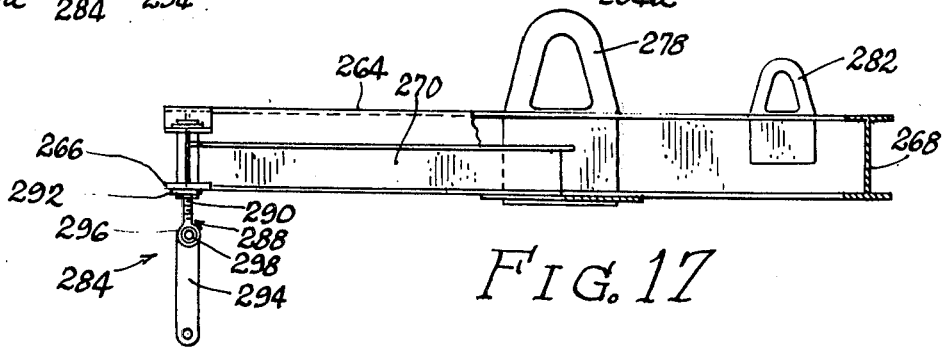

FIGS. 15–17 illustrate an improved bail 260 which may be employed very advantageously for lifting the middle and top wall sections 24 and 26. The illustrated bail 260 comprises a generally horizontal frame 262 having a main longitudinal member 264, end members 266 and 268 having their central portions connected to the ends of the member 264, side members 270 and 272 connected between the ends of the end members 266 and 268, and intermediate members 274 and 276 extending outwardly from the main longitudinal member 264 and connected to the side members 270 and 272. It will be seen that the end member 266 is considerably shorter than the end member 268 so that the bail is non-symmetrical.

The bail 260 is adapted to be lifted by a crane or the like. Thus, a main lifting loop or eye 278 projects upwardly from the main longitudinal member 264. It will be understood that the loop 278 is adapted to receive the lifting hook 280 of a crane or the like.

In this case, the bail 260 also includes a secondary lifting device in the form of a loop or eye 282, projecting upwardly from the main longitudinal member 264, at a point thereon between the primary lifting device 278 and the end member 268. The secondary lifting device 282 may be employed to assist in leveling or controlling the load on the bail 260.

In order to provide for the lifting of the wall sections 24 and 26, the illustrated bail 260 is provided with two pairs of suspension devices 284 and 284*a*, connected to the ends of the end members 266 and 268, and extending downwardly therefrom.

Each of the suspension devices 284 preferably comprises an adjustable member 288 having a screw-threaded portion 290 received in a threaded socket member 292 mounted on one end of the end member 266. The upper end of a connecting link 294 is connected to a forked portion 296 at the lower end of the member 288 by means of a pin or bolt 298 extending through appropriate openings in the link 294 and the forked portion 296.

Similarly, each of the suspension devices 284*a* comprises an adjustable member 288*a* having a threaded portion 290*a*, a threaded socket member 22*a*, a link 294*a*, a forked portion 296*a*, and a pin or bolt 298*a*. The socket members 292*a* are mounted on the ends of the end member 268.

In order that the wall sections 24 and 26 of the furnace shell 20 may hang level from the bail 260, the suspension devices 284 are closer together than the suspension devices 284*a*. Moreover, the suspension devices 284 are farther from the principal lifting device 278 than are the suspension devices 284*a*. It will be seen that the distance between the principal lifting device 278 and the end member 266 is greater than the distance between the lifting device 278 and the end member 268.

Each of the suspension devices 284 is displaced by an angle of about 30° from the longitudinal member 264 relative to the principal lifting device 278. On the other hand, each of the suspension devices 284*a* is displaced by an angle of about 45° from the longitudinal member 264. When the bail 260 is employed to lift the middle wall section 24, the links 294 of the suspension devices 284 are connected to the lifting elements 232, while the links 284*a* of the suspension devices 284*a* are connected to the lifting elements 234. In this way, the center of lift represented by the principal lifting device 278 is displaced from the geometrical center of the wall section 24 toward the pouring spout 60 to allow for the added weight of the pouring spout. Thus, the center of lift is aligned with the center of gravity of the wall section 24 so that it will hang level from the bail 260. It will be seen that the lifting elements 232 on the middle wall section 24 are closer together than the lifting elements 234.

When the bail 260 is employed to lift the top wall section 26, the orientation of the bail is reversed so that the links 294 of the suspension devices 284 are connected to the lifting elements 248, while the links 294*a* of the suspension devices 284*a* are connected to the elements 250. In this way, the center of lift represented by the principal lifting device 278 is shifted toward the slag door 102 and the apron 114 which contribute extra weight to the corresponding side of the top wall section 26. Here again, the center of lift corresponds with the center of gravity of the top wall section 26 so that it will hang level from the bail 260.

The ability of the bail 260 to support the wall sections 24 and 26 in a level manner is important because the level position of each wall section makes it easy to lower the wall section into place on the furnace shell without damaging the previously-installed refractory lining. The reversible non-symmetrical bail 260 makes it possible to lift both of the wall sections 24 and 26 in a level manner despite the differences in the locations of the centers of gravity of the two wall sections.

In operation, the furnace shell 20 may be employed for melting steel scrap or for various other purposes. The steel scrap is charged into the furnace shell from the top thereof. The heat to melt the steel is supplied by electric arcs drawn between electric arc electrodes, which extend into the furnace through openings in a roof or cover mounted on the top wall section 26. The roof or cover may be of any known or suitable construction.

When the molten steel is to be poured from the furnace shell 20, it is tilted or rocked so that the molten steel flows through the discharge opening 58 and over the refractory lining 64 in the pouring spout 60. Molten slag may be removed by tipping or rocking the furnace shell 20 in the opposite direction, while opening the door 102 so that the slag will be poured through the opening 110. The slag flows over the graphite blocks 118 which line the apron 114. The graphite blocks 118 withstand the heat of the slag and prevent the slag from adhering to the apron 114.

During the operation of the furnace, cooling water is circulated through the slag door 102 and also through the members 104, 106 and 108 which are employed to line the slag discharge opening 100. These members are thereby protected from damage due to the heat generated in the furnace shell 20. Cooling water is also circulated through the passages 126, 134 and 140 in the top wall section 126. The passages 134 and 140 extend along the joint between the top wall section 26 and the middle wall section 24 so as to prevent damage to the furnace if there is any leakage of heat through the joint. The passage 126 extends around the upper end of the top wall section 26 where it is engaged by the roof or cover. Thus, the cooling passage 126 prevents damage to the furnace due to any possible leakage of heat at this point.

As the furnace shell 20 is used, the refractory lining is gradually consumed so that eventually it becomes necessary to replace the lining. The refractory linings 38 and 42 of the wall sections 24 and 26 are subject to greater attrition and damage then the refractory lining 30 of the bottom section 22 because the refractory linings of the wall sections 24 and 26 are subject to more intense heat and greater thermal shock. Consequently, the lining 30 of the bottom section 22 may outlast two or more linings of the wall sections 24 and 26.

It is preferred to provide a set of spares for the wall sections 24 and 26. During the normal use of the furnace shell 20, the refractory linings 38 and 42 are installed in the spare wall sections 24 and 26. The linings 38 and 42 are supported by the ledges 90, 92 and 94 projecting inwardly at the lower ends of the wall sections 24 and 26.

When it becomes necessary to shut down the furnace to replace the refractory linings, the old wall sections 24 and 26 are removed from the furnace shell 20 by the us of the bail 260 and a suitable crane or hoist. The spare wall sections 24 and 26 complete with their refractory linings 38 and 42 are then hoisted into place on the furnace shell. The tapered pins 52 and 86 insure that the wall sections 24 and 26 will be maintained in alignment with the bottom section 22. Fireclay or some other refractory material is employed to close and seal the joints between the refractory linings 30, 38 and 40. The furnace shell 20 is then put back into service. While the furnace is in service, the refractory linings 38 and 42 of the original wall sections 24 and 26 are replaced so that these wall sections will be ready for installation on the furnace shell 20.

It will be evident that the furnace shell construction of the present invention makes it possible to replace the refractory lining of the furnace shell with only a very brief shutdown of the furnace.

I claim:

1. An electric arc furnace shell of the vertical axial type for use with molten metal, comprising a generally dish-shaped bottom section having a metal bottom casing and a refractory lining, said bottom section having a generally vertical axis and being generally circular in horizontal cross section, a first generally ring-shaped wall section removably mounted on top of said bottom section and having a first ring-shaped metal casing and a refractory lining, said first wall section being removable as a separate unit from said bottom section and being replaceable thereon, said first ring-shaped metal casing of said first wall section being separate from said bottom metal casing with a disengageable joint therebetween, said first ring-shaped wall section having a generally vertical axis and being generally circular in horizontal cross section, and a second generally ring-shaped wall section removably mounted on top of said first wall section and having a second ring-shaped metal casing and a refractory lining, said second wall section being removable as a separate unit from said first wall section and being replaceable thereon, said second ring-shaped metal casing being separate from said first ring-shaped metal casing with a disengageable joint therebetween, said second ring-shaped wall section having a generally vertical axis and being generally circular in horizontal cross section, each of said ring-shaped metal casings of said wall sections having its own means for supporting the refractory lining thereof when said wall section is dismounted from the furnace shell, whereby the refractory lining may be installed in each wall section prior to the mounting of the wall section on the furnace shell, said first and second wall sections constituting a generally ring-shaped side wall portion of said furnace shell, said side wall portion being generally barrel-shaped in that said first wall section flares upwardly in its internal horizontal diameter toward a maximum internal diameter, while said second wall section flares downwardly toward said maximum internal diameter, the barrel-shape of said side wall portion increasing the ability of said side wall portion to withstand electric arc action.

2. An electric arc furnace shell according to claim 1, in which said first wall section is formed with a slag discharge opening, said maximum internal diameter occurring above said slag discharge opening to enhance the volume in said furnace shell above said slag discharge opening whereby the ability of said furnace shell to withstand electric arc action is enhanced.

3. An electric arc furnace shell of the vertical axial type for use with molten metal, comprising a generally dish-shaped bottom section having a metal bottom casing and a refractory lining, said bottom section having a generally vertical axis and being generally circular in horizontal cross section, a first generally ring-shaped wall section removably mounted on top of said bottom section and having a first ring-shaped metal casing and a refractory lining, said first wall section having a generally vertical axis and being generally circular in horizontal cross section, and a second generally ring-shaped wall section removably mounted on top of said first wall section and having a second ring-shaped metal casing and a refractory lining, said second wall section having a generally vertical axis and being generally circular in horizontal cross section, said first and second wall sections constituting a generally ring-shaped side wall portion of said furnace shell, said side wall portion being generally barrel-shaped in vertical cross section in that said first wall section flares upwardly in its internal horizontal diameter toward a maximum horizontal internal diameter, while said second wall section flares downwardly in its internal horizontal diameter toward said maximum internal horizontal diameter, the barrel-shape of said side wall portion being effective to enhance the ability of said side wall portion to withstand electric arc action.

4. An electric arc furnace shell according to claim 3, in which said first wall section is formed with a slag discharge opening, said maximum internal horizontal diameter occurring above said slag discharge opening to enhance the volume in said furnace shell above said slag discharge opening whereby the ability of said furnace shell to withstand electric arc action above said slag discharge opening is enhanced.

5. An electric arc furnace shell of the vertical axial type for use with molten metal, comprising a generally dish-shaped bottom portion having a metal casing with a refractory lining, said bottom portion having a generally vertical axis and being generally circular in horizontal cross section, and a generally ring-shaped wall portion extending upwardly from said bottom portion and having a metal casing with a refractory lining, said wall portion having a generally vertical axis and being generally circular in horizontal cross section, said wall portion having a slag discharge opening therein, said wall portion being generally barrel-shaped in vertical cross section in that said wall portion has a lower portion flaring upwardly in its internal horizontal diameter toward a maximum internal horizontal diameter disposed above said slag discharge opening, said wall portion having an upper portion flaring downwardly in its internal horizontal diameter toward said maximum internal horizontal diameter, whereby the volume in said furnace shell above said slag discharge opening is enhanced and the ability of said wall portion to withstand electric arc action above said slag discharge opening is increased.

* * * * *